US007536147B2

(12) United States Patent
Kageyama

(10) Patent No.: US 7,536,147 B2
(45) Date of Patent: May 19, 2009

(54) CLEANING DEVICE AND IMAGE FORMING APPARATUS INCLUDING SAME

(75) Inventor: Hiroyuki Kageyama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 63 days.

(21) Appl. No.: 11/633,437

(22) Filed: Dec. 5, 2006

(65) Prior Publication Data

US 2007/0134035 A1 Jun. 14, 2007

(30) Foreign Application Priority Data

Dec. 12, 2005 (JP) ..... 2005-358265

(51) Int. Cl.
*G03G 21/00* (2006.01)

(52) U.S. Cl. ..... 399/350; 399/346; 399/349

(58) Field of Classification Search ..... 399/350, 399/346, 349, 353; 15/256.5, 256.51, 256.52
See application file for complete search history.

(56) References Cited

U.S. PATENT DOCUMENTS

| | | | | |
|---|---|---|---|---|
| 2004/0224245 | A1* | 11/2004 | Shigezaki et al. | 430/66 |
| 2005/0002705 | A1 | 1/2005 | Shintani et al. | 399/346 |
| 2005/0053853 | A1* | 3/2005 | Sugino et al. | 430/58.05 |
| 2006/0024100 | A1* | 2/2006 | Ohta et al. | 399/350 |
| 2007/0122218 | A1* | 5/2007 | Kageyama | 399/349 |

FOREIGN PATENT DOCUMENTS

| | | | |
|---|---|---|---|
| JP | 08-254841 | A * | 10/1996 |
| JP | 2000-267535 | | 9/2000 |
| JP | 2002-244486 | | 8/2002 |
| JP | 2003-58009 | | 2/2003 |
| JP | 2003-98925 | | 4/2003 |
| JP | 2004-334092 | | 11/2004 |
| JP | 2005-24953 | | 1/2005 |

OTHER PUBLICATIONS

Machine translation of JP 2003-058009 A dated Apr. 2, 2008.*

* cited by examiner

*Primary Examiner*—Sophia S Chen
(74) *Attorney, Agent, or Firm*—Nixon & Vanderhye, P.C.

(57) ABSTRACT

A cleaning device of the present invention includes (i) a blade, which has an edge portion to be pressed against a surface of a photoreceptor, so as to scrape toner and (ii) a brush roller, which has bristle whose ends make contact with the surface of the photoreceptor, so as to supply fine particles of a scraped lubricant agent to the surface of the photoreceptor, the blade having a rebound resilience of 10% to 45% and a Young's modulus of 5 MPa to 11 MPa. With this, even when small-particle toner with no corner is used, it is possible to (a) improve a cleaning property while allowing a photoreceptor to have a long life span and without degrading the original electrophotographic performance of the photoreceptor and (b) charge the photoreceptor uniformly.

6 Claims, 5 Drawing Sheets

FIG. 6

| EXAMPLES | LUBRICANT AGENT | BLADE REPULSIVE ELASTICITY | BLADE YOUNG'S MODULUS (Mpa) | LINE PRESSURE (N/cm) | CHARGING METHOD | BRUSH | CLEANABILITY | CHARGING CHARACTERISTICS | PHOTORECEPTOR ABRASION | PRINTED IMAGE QUALITY | COMPREHENSIVE EVALUATION |
|---|---|---|---|---|---|---|---|---|---|---|---|
| 1 | ZnSt | 40 | 5.8 | 0.18 | CONTACT CHARGING ROLLER, DC | NYLON、6DENIERS、60kf/inch$^2$ | ○ | ○ | ○ | ○ | ◎ |
| 2 | | | | 0.20 | | | ○ | ○ | ○ | ○ | ◎ |
| 3 | | | | | | NYLON、3DENIERS、215kf/inch$^2$ | ○ | ○ | ○ | ○ | ◎ |
| 4 | | 38 | 9.1 | | | NYLON、6DENIERS、60kf/inch$^2$ | ○ | ○ | ○ | ○ | ◎ |
| 5 | | | | 0.18 | | NYLON、3DENIERS、215kf/inch$^2$ | ○ | ○ | ○ | ○ | ◎ |
| 6 | | 40 | 5.8 | 0.26 | | | ○ | ○ | △ | ○ | ○ |
| 7 | | 23 | 7.4 | | | | ○ | ○ | △ | ○ | ○ |
| 8 | | 40 | 5.8 | | NONCONTACT SCOROTRON | NYLON、6DENIERS、60kf/inch$^2$ | ○ | ○ | △ | ○ | △ |
| 9 | | 38 | 9.1 | | | NYLON、3DENIERS、215kf/inch$^2$ | ○ | ○ | △ | ○ | △ |
| 10 | | 23 | 7.4 | 0.20 | | NYLON、6DENIERS、60kf/inch$^2$ | ○ | ○ | ○ | ○ | ◎ |
| 11 | | 13 | 4.7 | | CONTACT CHARGING ROLLER, DC | NYLON、3DENIERS、215kf/inch$^2$ | ○ | ○ | △ | ○ | ○ |

FIG. 7

| COMPARATIVE EXAMPLES | LUBRICANT AGENT | BLADE REPULSIVE ELASTICITY | BLADE YOUNG'S MODULUS (Mpa) | LINE PRESSURE (N/cm) | CHARGING METHOD | BRUSH | CLEANABILITY | CHARGING CHARACTERISTICS | PHOTORECEPTOR ABRASION | PRINTED IMAGE QUALITY | COMPREHENSIVE EVALUATION |
|---|---|---|---|---|---|---|---|---|---|---|---|
| 1 | ZnSt | 50 | 6.4 | 0.18 | CONTACT CHARGING ROLLER, DC | NYLON, 6DENIERS, 60kf/inch$^2$ | △ | × | △ | △ | × |
| 2 | | | | 0.26 | | | ○ | × | △ | × | × |
| 3 | | | | | | NYLON, 3DENIERS, 215kf/inch$^2$ | ○ | △ | × | △ | × |
| 4 | | | | | NONCONTACT SCOROTRON | | ○ | △ | × | △ | × |
| 5 | NA | 40 | 5.8 | 0.20 | | | × | △ | × | × | × |
| 6 | ZnSt | 8 | 5.3 | | CONTACT CHARGING ROLLER, DC | | △ | △ | × | △ | × |
| 7 | | 23 | 13.5 | | | | △ | △ | × | × | × |

CLEANING DEVICE AND IMAGE FORMING APPARATUS INCLUDING SAME

This Nonprovisional application claims priority under 35 U.S.C. § 119(a) on patent application No. 358265/2005 filed in Japan on Dec. 12, 2005, the entire contents of which are hereby incorporated by reference.

BACKGROUND

I. Field of the Invention

The present technology relates to: (i) a cleaning device which is provided in an image forming apparatus adopting an electrophotographic system and which removes residual toner by bringing a blade into contact with a surface of an image carrier such as a photoreceptor drum; and (ii) an image forming apparatus including the cleaning device. More specifically, the present technology relates to a cleaning device more suitable for use in an image forming apparatus in which an image carrier is charged by using a contact charging system.

II. Related Art and other Considerations

According to an electrophotographic system adopted by an image forming apparatus such as a copier or a laser printer, the following operations are carried out. Specifically, a surface of a photoreceptor serving as an image carrier is charged by a charging device. Thereafter, an electrostatic latent image is formed by carrying out an exposure with the use of an exposure device, and a toner image is formed by developing the electrostatic latent image with the use of a developing device. Then, the toner image is electrostatically transferred, for example, onto a paper sheet (transferring medium), by a transferring device. Thereafter, the toner image thus transferred onto the paper sheet is fixed by a fixing device. Thus, an image is formed on the paper sheet.

The charging device is mainly classified into two types: (i) a contact-charging-type charging device using a charging roller, a charging brush, or other member; and (ii) a noncontact-charging-type charging device typified by corona charging. Among these, the contact-charging-type charging device brings a charging member such as a roller or a brush into direct contact with a photoreceptor so as to cause electrons to adhere to the photoreceptor. Therefore, the contact-charging-type charging device has the following advantages (1) to (3): (1) charging can be carried out efficiently; (2) a low voltage can be applied to the charging member; and (3) only a very small amount of ozone, which is a cause of environmental pollution, is generated.

Further provided around the photoreceptor is a cleaning device for removing toner remaining on the photoreceptor. Because of space-saving, design simplicity, mechanism simplicity, and/or other reason, a cleaning device that is frequently used today uses a blade (cleaning blade) that scrapes toner by making contact with a surface of a photoreceptor.

Further, for the purpose of realizing an image with high resolution, a high-speed machine and a color machine, which have been a recent mainstream type of electrophotographic image forming apparatus, start to use toner (small-particle toner) having a small particle diameter of approximately 5 μm. Among other small-particle toner, shape-controlled toner is widely used which is produced, for example, by a polymerization method in consideration of a cleaning property.

The blade carries out toner cleaning as follows. Force is applied, in a direction parallel to a surface of a photoreceptor, to toner adhering to the surface of the photoreceptor by electrostatic force (coulomb force) and mechanical force (van der Waals' force). The toner slides along the photoreceptor so as to be removed. On this occasion, since spherical toner with no corner has a larger contact area with respect to the surface of the photoreceptor than that of toner with a corner and without regular shape, a great frictional force is exerted. This causes the spherical toner with no corner to have a difficulty of sliding along the photoreceptor. Instead, it is easy for the spherical toner to roll. As a result, the spherical toner rolls in a space between the photoreceptor and the cleaning blade, and so scrapes through the cleaning blade. This makes it difficult to carry out cleaning. Only a small effect is brought about simply by increasing the line pressure of the blade. Instead, the abrasion of the photoreceptor is accelerated, so that the photoreceptor has a short life span.

The following describes examples of conventional techniques for solving such problems.

According to Japanese Unexamined Patent Publication No. 58009/2003 (Tokukai 2003/58009; published on Feb. 28, 2003), a lubricant agent such as zinc stearate is applied to a surface of a photoreceptor with the use of a cleaning blade, so that the coefficient of sliding friction of toner is reduced. In this case, the cleaning blade is set to have a rebound resilience of 45% to 65% and a line pressure of 0.2 N/cm to 0.5 N/cm.

Further, according to Japanese Unexamined Patent Application No. 267535/2000 (Tokukai 2000-267535; published on Sep. 29, 2000, a cleaning blade is set so as to have a JIS A hardness of 70° to 80° and a rebound resilience of 20% to 40%.

According to Japanese Unexamined Patent Application No. 98925/2003 (Tokukai 2003/98925; published on Apr. 4, 2003), a photoreceptor 1 has a surface layer that contains siloxane resin, and a cleaning blade is set so as to have a rebound resilience of 5% to 30% at 30° C. and a rebound resilience of 10% to 40% at 40° C.

However, in cases where small-particle toner with no corner is used, the arrangements respectively described in Tokukai 2003-58009, Tokukai 2000-267535, and Tokukai 2003-98925 suffer from the following problems (1) to (4): (1) the photoreceptor cannot be charged uniformly; (2) a cleaning property is low; (3) the photoreceptor has a short life span; and/or (4) the original electrophotographic performance of the photoreceptor is degraded.

According to the arrangement of Tokukai 2003-58009, although the lubricant agent is applied to the surface of the photoreceptor because the blade has a rebound resilience of 45% to 65%, the blade is caused to make contact with the spherical toner at a high line pressure and a high modulus. For this reason, the photoreceptor is easily worn away due to friction with the blade. This causes the photoreceptor to have a short life span. In addition, in cases where the blade having such a high rebound resilience of 45% to 65% is used, for example, in a high-speed machine operating at a processing speed of 300 mm/sec, the amplitude of a stick-slip motion is so high that the toner easily passes through a space between the photoreceptor and the blade. This causes a cleaning property to be reduced. The stick-slip motion will be described later.

Further, since the lubricant agent is applied by a brush or the like, the surface of the photoreceptor is made uneven by fine particles of the lubricant agent. However, the blade having a rebound resilience of 45% to 65% cannot make the unevenness even because the edge portion of the blade is pressed against the photoreceptor but is little squashed. Therefore, the unevenness on the surface of the photoreceptor easily causes uneven charging, and causes a charge leak especially when the cleaning device is combined with a contact-charging-type charging device.

Further, according to Tokukai 2000-267535, the properties of the blade are defined in accordance with (i) the circumferential velocity of the photoreceptor, (ii) the resin contained in the toner, and (iii) the average particle diameter of the toner. However, small-particle toner with no corner has a problem with a cleaning property.

Further, according to Tokukai 2003-98925, the surface layer of the photoreceptor contains siloxane resin for the purpose of ensuring a high cleaning property. However, this degrades the original electrophotographic performance of the photoreceptor.

SUMMARY OF THE INVENTION

It is an object of the present technology to provide:

(i) a cleaning device which improves a cleaning property while allowing a photoreceptor to have a long life span and without degrading an electrophotographic performance intrinsic to the photoreceptor and uniformly charges the photoreceptor, even when small-particle toner with no corner is used; and (ii) an image forming apparatus including the cleaning device.

In order to attain the foregoing object, a cleaning device of the present technology is a cleaning device provided in an image forming apparatus so as to remove toner from a surface of an image carrier that is driven to rotate. The cleaning device includes a blade, which has an edge portion to be pressed against the surface of the image carrier, so as to remove the toner; and a rotary brush. The rotary brush is provided in an upstream side of a rotation direction of the image carrier with respect to the blade, and has bristles whose ends make contact with the surface of the image carrier, so as to supply a lubricant agent to the surface of the image carrier. The blade comprises a blade material having a rebound resilience of 10% to 45%, which is measured by using a JIS K6255 Lupke pendulum type rebound resilience tester, and a Young's modulus of 5 MPa to 11 MPa.

With this, the lubricant agent is supplied to the image carrier by the rotary brush. Therefore, the lubricant agent thus supplied (i) makes it possible to reduce the coefficient of friction between the blade and the image carrier, and (ii) causes the toner to be less adherent to the image carrier. With this, even when small-particle toner with no corner is used, the blade allows a good cleaning property. Furthermore, because the lubricant agent is not contained in a photosensitive layer of the image carrier, the original electrophotographic performance of the image carrier is not degraded.

Moreover, the blade preferably has a rebound resilience of 10% to 45%, more preferably 10% to 40%. Therefore, the abrasion of the image carrier is not accelerated, and the image carrier can be uniformly charged. Even when a contact-charging-type charging device is adopted as the charging device, a charge leak or other problem due to charge concentration does not occur.

That is, the surface of the image carrier becomes uneven because the lubricant agent is supplied to a portion where the bristles of the brush make contact with the surface of the image carrier. For this reason, in cases where a contact-charging-type charging device is combined, a charge leak may be caused. However, the use of the blade having a rebound resilience of 45% or lower allows the lubricant agent to be distributed uniformly on the surface of the image carrier because the edge portion of the blade is appropriately squashed when pressed against the image carrier. When the rebound resilience exceeds 45%, the edge portion is little squashed and it is hard to make the unevenness even. Meanwhile, it is not preferable that the rebound resilience of the blade be lower than 10%. The reason for this is as follows: although the coefficient of friction between the image carrier and the blade is reduced by the lubricant agent, the blade makes contact with the image carrier in a wide range, so that the image carrier is easily worn away. Further, when the rebound resilience is lower than 10%, the resilience of the blade is so low that the blade cannot recover from deformation. This may cause the blade to have a short life span.

Furthermore, the blade preferably has a Young's modulus of 5 MPa to 11 MPa, more preferably 5 MPa to 10 MPa. This allows the blade to be highly elastic and hard. With this, the blade can prevent even small-particle toner with no corner from passing through a space between the image carrier and the blade, and therefore can surely bank up and remove the toner.

That is, as the Young's modulus of the blade becomes higher the blade banks up the toner better but the abrasion of the image carrier is accelerated. For this reason, a conventional blade has a Young's modulus of 3 MPa to 5 MPa. However, since the rebound resilience of the blade is set to fall within the aforementioned low range, the blade can have a higher Young's modulus than that of the conventional blade. This makes it possible to improve a cleaning property while reducing the abrasion of the photoreceptor.

However, when the Young's modulus exceeds 11 MPa, the image carrier is easily worn away. On the other hand, when the Young's modulus is less than 5 MPa, the elastic force becomes so low that the toner easily passes through a space between the image carrier and the blade.

With this, even when small-particle toner with no corner is used, it is possible to (i) improve a cleaning property while allowing a photoreceptor to have a long life span and without degrading the original electrophotographic performance of the photoreceptor and (ii) charge the photoreceptor uniformly.

Therefore, even when the cleaning device of the present technology is provided in a high-speed machine using small-particle toner with no corner, the cleaning device of the present technology (i) improves a cleaning property while allowing a photoreceptor to have a long life span and without degrading the original electrophotographic performance of the photoreceptor and (ii) charges the photoreceptor uniformly.

An image forming apparatus of the present technology is an image forming apparatus, including: an image carrier that is driven to rotate; a charging device for charging the image carrier; an exposure device for forming an electrostatic latent image on the image carrier; a developing device for developing, with toner, the electrostatic latent image formed on the image carrier; a transferring device for transferring a developed toner image to a transferring medium; and a cleaning device for removing residual toner from the image carrier, the cleaning device including (i) a blade, which has an edge portion to be pressed against a surface of the image carrier, so as to remove the toner and (ii) a rotary brush, which is provided in an upstream side of a rotation direction of the image carrier with respect to the blade, and which has bristles whose ends make contact with the surface of the image carrier, so as to supply a lubricant agent to the surface of the image carrier, the blade being made of a blade material having a rebound resilience of 10% to 45% and a Young's modulus of 5 MPa to 11 MPa.

It is preferable that the blade make contact with the image carrier at a contact angle of 6° to 25°. When the contact angle is less than 6°, the lubricant agent passes through a space between the image carrier and the blade. This causes application efficiency to be worse. On the other hand, when the contact angle is greater than 25°, an increase in torque on the image carrier, a turnover phenomenon of the blade, or damage of the edge of the blade easily occur under such an environment and/or condition that the friction between the blade and the surface of the image carrier is very high.

Further, in cases where the charging device is a contact-charging-type charging device including a contact charging member for charging the image carrier by making contact with the image carrier, the charging device is easily affected by a cleaning result. Therefore, the arrangement brings about a more remarkable effect.

As described above, even when small-particle toner with no corner is used, a cleaning device of the present technology (i) improves a cleaning property while allowing a photoreceptor to have a long life span and without degrading the original electrophotographic performance of the photoreceptor and (ii) charges the photoreceptor uniformly. Therefore, even when an image forming apparatus including such a cleaning device adopts a contact-charging-type charging device, problems such as a charge leak never occur in the image carrier and it is possible to provide an image with stable quality over a long period of time.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6 is a diagram showing (i) conditions set in Examples of the present technology and (ii) evaluation results obtained in Examples of the present technology.

FIG. 7 is a diagram showing (i) conditions set in Comparative Examples of the present invention and (ii) evaluation results obtained in Comparative Examples of the present technology.

DETAILED DESCRIPTION

An example embodiment according to the present technology is described below and in non-limiting fashion with reference to FIGS. 1 to 6.

Figure 2:
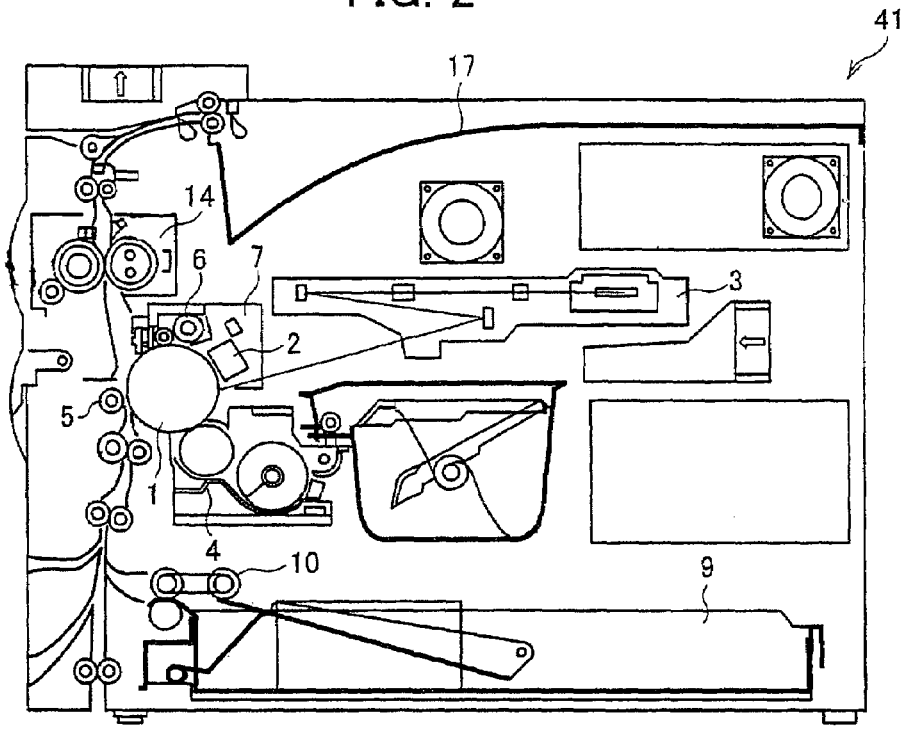
FIG. 2 is a cross-sectional view showing an arrangement of an image forming apparatus including the cleaning device shown in FIG. 1.

First, a whole arrangement of an image forming apparatus (electrophotographic apparatus) 41 including a cleaning device according to the present embodiment will be described with reference to FIG. 2. FIG. 2 is a longitudinal cross sectional view of the image forming apparatus 41 as seen from the front side thereof.

The image forming apparatus 41 forms an image (monochrome image in this case) on a paper sheet in accordance with image data. The image forming apparatus 41 includes a photoreceptor (electrostatic latent image carrier) 1. Provided around the photoreceptor 1 are a charging device (charging means) 2, an exposure device (exposure means) 3, a developing device (developing means) 4, a transferring device (transferring means) 5, cleaning device (cleaning means) 6, and an electricity-removing device 7, which comprise structure for carrying out well-known Carlson process.

The photoreceptor 1 has a shape of a drum. As the photoreceptor 1 rotates, a surface of the photoreceptor 1 is uniformly charged by the charging device 2 so as to have a predetermined potential. The exposure device 3 forms an electrostatic latent image on the surface of the photoreceptor 1 in accordance with image data. The developing device 4 visualizes the electrostatic latent image with toner. The image thus visualized is transferred by the transferring device 5 onto a paper sheet which has been supplied by a pick-up roller 10 from a paper sheet feeding tray 9 and whose top has been aligned with the top of the image. Thereafter, the paper sheet is sent to a fixing device 14. When the paper sheet passes through the fixing device, the toner image is melted and fixed onto the paper sheet. Thereafter, the paper sheet onto which the toner image has been fixed is discharged onto a loading tray 17.

Meanwhile, after the toner image has been transferred onto the paper sheet, the cleaning device 6, which will be fully described later, removes toner remaining on the surface of the photoreceptor 1. Thereafter, the electricity-removing device 7 removes charge remaining on the surface of the photoreceptor 1. Then, the surface of the photoreceptor 1 is recharged by the charging device 2.

Either of a contact-charging-type charging device and a noncontact-charging-type charging device such as a scorotron charger can be selected as the charging device 2. However, the cleaning device of the present technology is more effective when used in combination with a contact-charging-type charging device.

Figure 3:
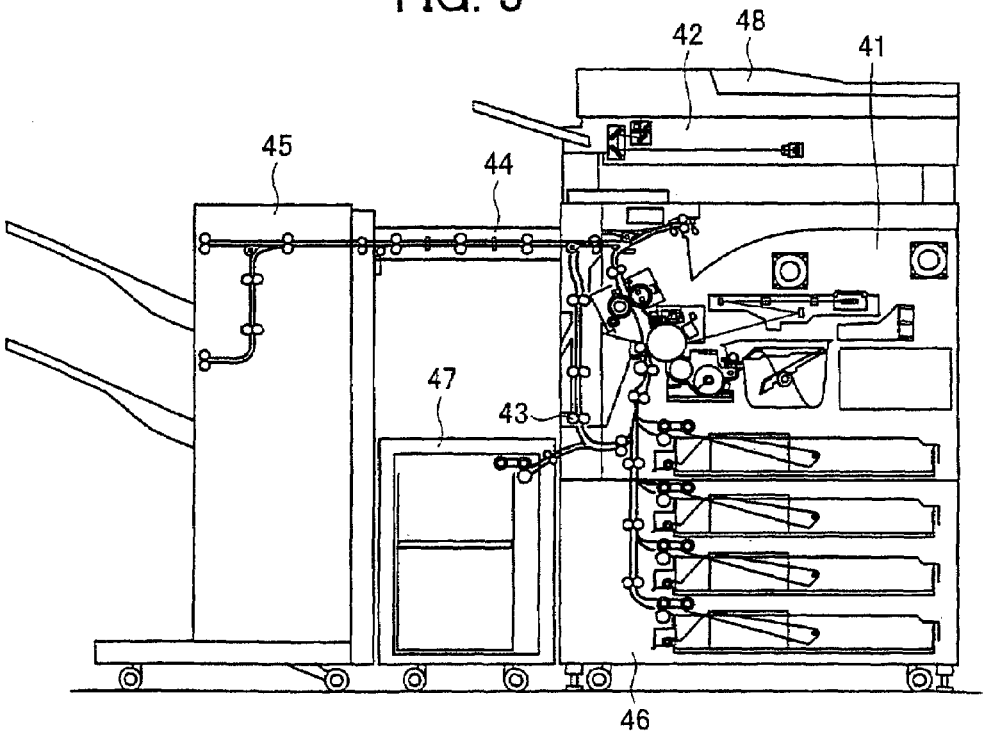
FIG. 3 is a cross-sectional view illustrating that an optional device is added to the image forming apparatus shown in FIG. 2.

Although no further explanation will be given, the image forming apparatus 41 is able to form images on both sides of the paper sheet by reversing the paper sheet. Further, as shown in FIG. 3, the image forming apparatus 41 can be provided with optional devices such as an image reading device 42, an automatic document feeder 48, a post-processing device 45, a relay transporting device 44, a recording material resupplying device 43, and recording material supplying devices 46 and 47.

Figure 1:
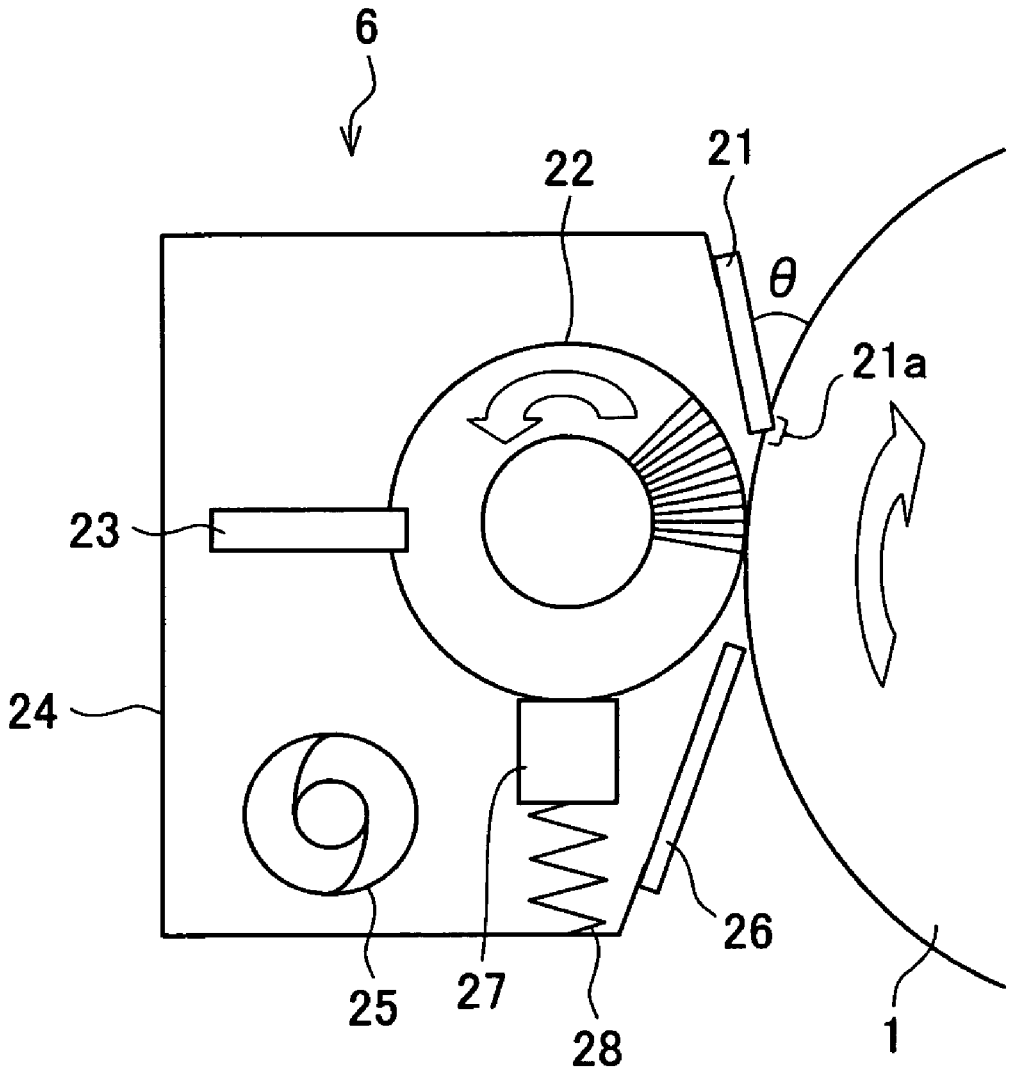
FIG. 1 is a diagrammatic view showing an arrangement of an example embodiment of a cleaning device.

The following fully explains the cleaning device 6. FIG. 1 shows an arrangement of the cleaning device 6. In FIG. 1, Reference Numeral 21 denotes a blade (cleaning blade) that scrapes the toner remaining on the surface of the photoreceptor 1. The blade 21 is a rectangular rubber member whose longer sides extend in an axial direction of the photoreceptor 1, and is disposed so that: one of the longer sides is fixed in an opening provided in a case 24, so as to be positioned in the downstream side with respect to the rotation direction of the photoreceptor 1; and the other one of the longer sides has an edge (corner) 21*a* that makes contact with the surface of the photoreceptor 1.

Figure 4:
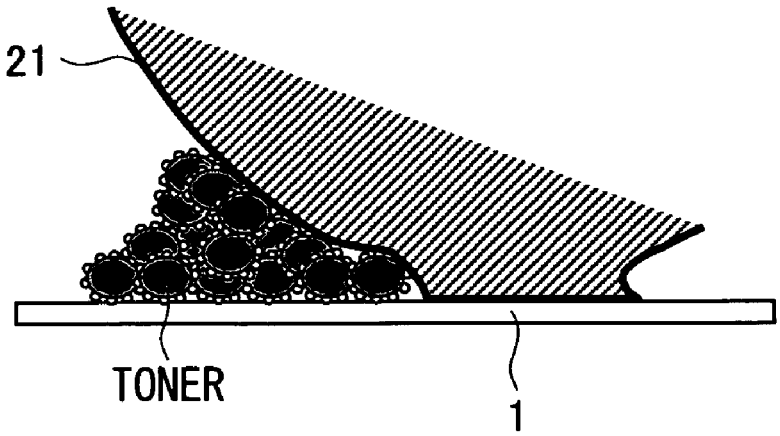
FIG. 4 is a diagram illustrating that a blade provided in the cleaning device removes toner from a photoreceptor.
Figure 5:
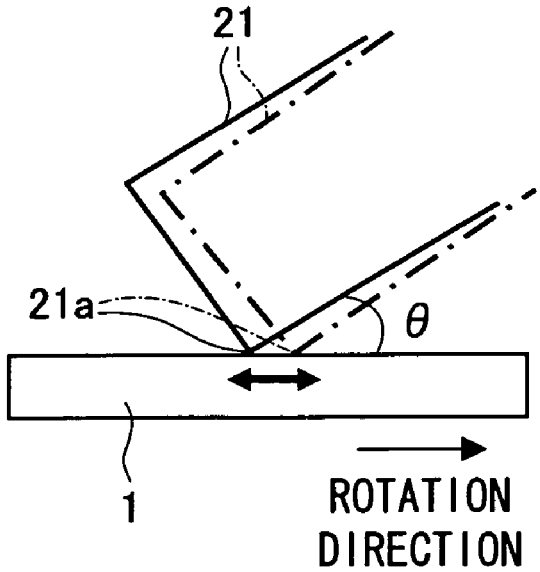
FIG. 5 is a diagram explaining a stick-slip motion of the blade provided in the cleaning device.

After the transferring, the blade 21 makes a stick-slip motion so as to scrape off residual toner from the surface of the photoreceptor 1, with the result that the toner thus removed is banked up in a position where the blade 21 makes contact with the photoreceptor 1 (see FIG. 4). As shown in FIG. 5, the stick-slip motion refers to a motion made by alternately repeating (i) such a motion that the contact portion of the blade 21 with the photoreceptor 1 is caused, due to the rotation of the photoreceptor 1, to move in the rotation direction of the photoreceptor 1 and (ii) such a motion that the blade 21 returns to its original position with its own elastic force. That is, the stick-slip motion refers to such a motion that the edge 21*a* of the blade 21 slides on and along the surface of the photoreceptor 1.

The case 24 houses a brush roller 22, a toner transporting screw 25, and a lubricant agent 27. The brush roller 22 is arranged so as to be rotated in a forward direction with respect to the rotation direction of the photoreceptor 1 (i.e., so as to be rotated in a direction opposite to the rotation direction of the photoreceptor 1), and is provided so that ends of bristles of a brush of the brush roller 22 make contact with the surface of the photoreceptor 1. Moreover, the brush roller 22 scrapes the lubricant agent 27 provided in an upstream side of a rotation direction of the brush with respect to a position where the brush roller 22 makes contact with the photoreceptor 1. The lubricant agent thus scraped is supplied to the surface of the photoreceptor 1 in the form of fine particles.

The application of the fine particles of the lubricant agent 27 to the surface of the photoreceptor 1 makes it possible to reduce a coefficient of friction between the blade 21 and the surface of the photoreceptor 1, and causes the toner to be less adherent to the surface of the photoreceptor 1. This allows the blade 21 to remove the toner efficiently.

Further, the brush roller 22 serves to scatter, by making contact with the photoreceptor 1, the toner adhering to the surface of the photoreceptor 1. This also allows the blade 21 to remove the toner efficiently. Furthermore, the brush roller 22 is provided in such a position that the brush roller 22 is able to collect the toner banked up and scraped by the blade 21, and has a function of (i) brushing off the surface of the photoreceptor 1 with its bristles so as to remove the toner scraped by the blade 21 and (ii) collecting up the toner into the case 24. Further, the brush roller 22 is provided with a flicker 23. The flicker 23 hits against toner adhering to the brush roller 22, with the result that the toner falls off from the brush roller 22 to the case 24.

Examples of the lubricant agent 27 include (i) a fatty acid metal salt known as a metal soap and (ii) a fluorocarbon resin. Examples of the fatty acid metal salt include a relatively high-order fatty acid such as zinc stearate, copper stearate, iron stearate, magnesium palmitate, zinc oleate, calcium palmitate, manganese oleate, or zinc oleate. Since water contained in the lubricant agent 27 affects the charging ability etc., of the photoreceptor 1, it is preferable that the lubricant agent 27 have a hygroscopicity of 0.5% or less. Furthermore, the lubricant agent 27 may be mixed with a porous powder such as porous glass or zeolite for the purpose of removing a corona product.

Further, the lubricant agent 27 is biased toward the brush roller 22 by a biasing member 28 constituted by a spring and other members, so that the brush roller 22 surely scrapes the lubricant agent 27 and supplies the lubricant agent 27 to the photoreceptor 1 regardless of the remaining amount of the lubricant agent 27.

The toner transporting screw 25 is disposed on a bottom surface side of the case 24, and discharges the collected toner into a waste toner box (not shown) provided outside of the case 24. A sealing member 26 is provided in the opening of the case 24 so as to be positioned in the upstream side with respect to the rotation direction of the photoreceptor 1. The sealing member 26 prevents the collected toner from leaking again from the case 24.

The properties of a blade material of the blade 21 of the cleaning device 6 are arranged so that such a lubricant agent 27 is supplied to the photoreceptor 1. In the image forming apparatus, the material of the blade 21 is so set as to have a rebound resilience of 10% to 45% and a Young's modulus of 5 Mpa to 11 MPa.

As described above, as the rebound resilience of the blade becomes lower, a cleaning property can be improved at a lower line pressure. The reason for this is as follows: as the rebound resilience becomes smaller, an edge portion, which is pressed against the photoreceptor 1, of the blade 21 is more easily squashed and the blade 21 makes a smoother stick-slip motion. That is, as shown in FIG. 4, when the rebound resilience is low, even a low line pressure causes the edge portion to be squashed, so that the blade 21 makes contact with the photoreceptor 1 across a wide range and makes a low-vibration stick-slip motion. With this, even small-particle toner cannot pass through such a wide contact portion, and therefore is banked up therein. This allows a cleaning property to be improved.

Moreover, since the rebound resilience is set to fall within a range of 10% to 45% in this case, the abrasion of the photoreceptor 1 and the functional deterioration of the blade 21 are not accelerated. Moreover, even when the charging device 2 is a contact-charging-type charging device, a charge leak or other problem due to charge concentration does not occur. This makes it possible to improve the charging characteristics of the photoreceptor 1. The rebound resilience is more preferably set to fall within a range of 10% to 40%.

That is, fine particles of the lubricant agent 27 applied (supplied) to the surface of the photoreceptor 1 with the use of the brush roller 22 gather in or near a portion where the bristles of the brush of the brush roller 22 make contact with the photoreceptor 1. This causes the surface of the photoreceptor 1 to be uneven, so that the charging characteristics of the surface of the photoreceptor 1 are reduced. Especially when combined with a contact-charging-type charging device, a charge leak is undesirably caused. In cases where the rebound resilience is set to be 45% or lower, the squashed portion of the edge portion of the blade 21 allows the fine particles to be distributed uniformly on the surface of the photoreceptor 1. However, in cases where the rebound resilience exceeds 45%, the squashed portion of the edge portion becomes so small that it is hard to make the unevenness even.

Further, in cases where the rebound resilience becomes lower than 10%, the photoreceptor 1 is easily worn away due to the contact with the blade 21 in the wide range although the coefficient of friction between the photoreceptor 1 and the blade 21 is reduced by the lubricant agent 27. Further, in cases where the rebound resilience becomes lower than 10%, the blade 21 has such a small resilience as to be unable to recover from deformation. This causes the toner to easily pass through a space between the photoreceptor 1 and the blade 21 shortly after the blade 21 starts to be used.

Furthermore, in this case, the Young's modulus of the blade 21 is set to fall within a range of 5 MPa to 11 MPa. This allows the blade 21 to be highly elastic and hard. Thus, the blade 21 can prevent even small-particle toner with no corner from passing through a space between the photoreceptor 1 and the blade 21, and therefore can bank up and remove the small-particle toner with no corner.

As the Young's modulus of the blade 21 is increased, the blade 21 can be more highly elastic and harder, and therefore gains stronger power of accumulating the toner. However, when the blade 21 is caused to be more elastic, the abrasion of the photoreceptor 1 is accelerated. For this reason, a conventional blade has a Young's modulus of 3 MPa to 5 MPa. In contrast, according to the present technology, the rebound resilience of the blade 21 is reduced by applying the lubricant agent to the surface of the photoreceptor in order to reduce the coefficient of friction as described above. Therefore, even when the Young's modulus is increased, the abrasion of the photoreceptor 1 is reduced. This allows a cleaning property to be improved.

However, when the Young's modulus exceeds 11 MPa, it becomes hard to avoid the problem of the abrasion of the photoreceptor 1 no matter how much the rebound resilience is reduced. Therefore, in this case, the Young's modulus is set to be 11 MPa. Further, the lower limit for the Young's modulus is set to be 5 MPa. The reason for this is as follows: the blade 21 caused to have a low rebound resilience has too small an elastic force when the Young's modulus is less than 5 MPa, with the result that the toner easily passes through a space between the photoreceptor 1 and the blade 21.

With this, even when the cleaning device 6 is provided in a high-speed machine using small-particle toner with no corner, it is possible to (i) extend the life of the photoreceptor without reducing a cleaning property and (ii) improve a charging state of the photoreceptor. The Young's modulus is preferably set to fall within a range of 5 MPa to 10 MPa.

The small-particle toner with no corner refers to toner particles each having substantially (i) no protrusion where electric charge is likely to concentrate or (ii) no protrusion that is likely to be abraded due to stress. That is, the small-particle toner with no corner refers to such toner particles with no corner that: in cases where a circle having a radius of L/10 (where L is the longer diameter of a toner particle) rolls inside of the circumference of the toner particle in touch with the inside of the circumference at one point, the circle does not substantially go off from the circumference of the toner particle. The case where the circle does not substantially go off from the circumference of the toner particle refers to a case where there is at most one protrusion where the circle goes off from the circumference of the toner particle. Further, the longer diameter of a toner particle refers to a particle width obtained when the distance is longest between two parallel lines sandwiching a projective image of the toner particle on a plane surface.

A checked to determine whether or not each toner particle has a corner is as follows. First, a close-up picture of a toner particle was taken by using a scanning electron microscope. Next, the close-up picture thus taken was magnified by 15,000 times. Then, it was determined, in accordance with the picture image, whether or not the aforementioned protrusion exists.

A method for obtaining such toner with no corner is not particularly limited. For example, toner with no corner can be obtained by (i) spraying toner particles into a thermal air current, (ii) repeatedly exerting mechanical energy, generated by shock power, to toner particles in the gas phase, or (iii) adding toner to a solvent, in which the toner is never dissolved, and swirling the solvent.

Further, each particle of polymerization toner, to be formed by combining or fusing resin particles with one another, has a surface having a large number of irregularities in a fusion stopping stage, and therefore the surface thereof is not flat and smooth. However, toner with no corner is obtained by appropriately setting (i) a temperature, (ii) the number of times a stirring impeller is rotated, (iii) stirring time, and the like in a shape control step. These conditions vary depending on the property of a constituent resin. For example, by rotating the stirring impeller at a higher speed at a temperature above the glass-transition temperature of the constituent resin, the surface becomes smooth, with the result that toner with no corner is manufactured. The small particle toner in the present invention refers to toner having a volume average particle diameter of 4 μm to 8 μm.

Further, the term "high-speed machine (high-speed image forming apparatus)" refers to a machine operating at a processing speed of 300 mm/s or faster.

Examples of a material that can be used as the blade 21 include a plate elastic member made of urethane rubber, silicon rubber, chloroprene rubber, butadiene rubber, or the like.

Further, in addition, the material of the blade 21 preferably has an irreversible stretch of 1% or less and a tearing strength of 350 N/cm or greater. With this, the blade is unlikely to be permanently fatigued due to stress imposed thereon and is unlikely to be chipped off. Accordingly, a cleaning property is stably ensured over a long period of time, and the lubricant agent is applied to the surface of the photoreceptor 1 so as to have a uniform thickness.

Furthermore, the density of the bristles of the brush of the brush roller 22 for applying the lubricant agent 27 is preferably set at 20,000 (20K)/inch$^2$ or greater. In this case, the lubricant agent is applied to the photoreceptor 1 with very little unevenness, and no uneven concentration is found in a low-concentration portion of a toner image formed on a recording medium. However, when the density of the bristles of the brush exceeds 500,000/inch$^2$, the density is too high for the brush to function properly. In the first place, it is not easy to produce a brush having bristles whose density is 500,000/inch$^2$ or greater. Therefore, practically speaking, it is most preferable that the density of the bristles of the brush be set to fall within a range of 20,000/inch$^2$ to 500,000/inch$^2$. Further, each of the bristles of the brush preferably has a thickness of 2 deniers to 10 deniers. It is not preferable that the thickness of each of the bristles of the brush be less than 2 deniers, because the bristles of the brush are so thin that the lubricant agent is scraped insufficiently. It is not preferable that the thickness of each of the bristles of the brush exceeds 10 deniers, because the surface of the photoreceptor is greatly damaged and the photoreceptor is greatly worn away.

The blade 21 is formed so as to have, e.g., a free end length of 9.0 mm (have shorter sides each having a length of 9.0 mm), a thickness of 2.0 mm, and a whole length of 326 mm (have longer sides each having a length of 326 mm), and is brought into contact with the photoreceptor 1 having a diameter of 80 mm, in accordance with a leading method and a constant load method. On this occasion, the blade 21 is preferably set so as to (i) clean the photoreceptor 1 at a cleaning angle (contact angle) of 6° to 25° and (ii) be depressed by 0.3 mm to 1.5 mm when pressed against the photoreceptor 1.

The cleaning angle of the blade 21 refers to an angle θ (see FIG. 1) formed, in the downstream side of the rotation direction of the photoreceptor 1, between (i) the surface of the photoreceptor 1 on which surface the edge 21*a* of the blade 21 put under load via a blade holder slides and (ii) a surface of the blade 21 which surface faces the photoreceptor 1. A smaller cleaning angle θ increases a degree of freedom that the tip (edge 21*a* portion) of the blade 21 moves in a sliding direction in contact with the photoreceptor 1, and therefore is good for a stick-slip motion. This makes it possible to realize a smooth stick-slip motion. However, too large a cleaning angle θ is likely to cause (i) an increase in torque on the photoreceptor 1, (ii) a turnover phenomenon of the blade 21, or (iii) damage of the edge 21*a* of the blade 21 under such an environment and/or condition that the friction between the blade 21 and the surface of the photoreceptor 1 is very high.

In light of this, according to the present embodiment, the cleaning angle θ is set to fall within the aforementioned range. This makes it possible that a stick-slip motion is realized without the aforementioned problems even under such an environment and/or condition that the friction between the blade 21 and the surface of the photoreceptor 1 is very high.

Further, the blade 21 preferably exerts a line pressure of 0.10 N/cm to 0.26 N/cm (1.0 gf/mm to 2.6 gf/mm) onto the photoreceptor 1, more preferably 0.15 N/cm to 0.20 N/cm (1.5 gf/mm to 2.0 gf/mm). With this, while an effective stick-slip motion is carried out, the toner is surely prevented from passing through a space between the blade 21 and the photoreceptor 1. This makes it possible to improve a cleaning property and to restrain the abrasion of the photoreceptor 1.

The higher the line pressure is, the more difficult it is that the blade 21 is pushed up by the toner remaining after transfer and adhering to the surface of the photoreceptor 1. Therefore, the toner is surely subjected to force by which the toner is banked up, so that a cleaning property is improved. However, when the line pressure is higher than 0.26 N/cm, the photoreceptor is worn away with ease and the lubricant agent is applied to the photoreceptor so as to have an uneven thickness in a circumferential direction of the photoreceptor. However, according to the present invention, the lubricant agent is applied to the surface of the photoreceptor, and the rebound resilience of the blade 21 is set to fall within the aforementioned range. Therefore, even at such a low line pressure of 0.20 N/cm, it is possible to improve a cleaning property and to effectively restrain the abrasion of the photoreceptor 1. However, when the line pressure is less than 0.10 N/cm, the following problems (1) and (2) arise: (1) the lubricant agent may not be applied uniformly; and (2) no matter what a high Young's modulus the blade 21 has, the toner passes through a space between the photoreceptor 1 and the blade 21 with ease because the pressure of pressing the blade 21 against the photoreceptor is too weak.

FIGS. 6 and 7 show Examples of the cleaning device of the present technology and Comparative Examples. In each of Examples and Comparative Examples, a contact-charging-type charging roller (DC bias application) and a noncontact-type scorotron charger were used as the charging device 2. In examination of Examples and Comparative Examples, the rebound resilience of the blade, the Young's modulus of the blade, the line pressure of the blade, the thickness of each bristle of the brush roller, and the density of bristles of the brush roller were changed in various ways. The processing speed was 395 mm/sec. Moreover, a cleaning property, charging characteristics, photoreceptor wearing characteristics, and printed image quality were evaluated, and comprehensive evaluation was made. The symbol "d" in the column "BRUSH" of each of FIGS. 6 and 7 indicates the thickness of each of brush bristles, and "6 d" means "6 deniers". Further, the symbol "F/inch$^2$" in the column "BRUSH" indicates the density of brush bristles, and "60 kef/inch$^2$" represents a case where 60,000 brush bristles are planted per inch$^2$.

In each of Examples and Comparative Examples, the blade 21 has a free end length of 9.0 mm (has shorter sides each having a length of 9.0 mm), a thickness of 2.0 mm, and a whole length of 326 mm (has longer sides each having a length of 326 mm), and is brought into contact with the photoreceptor 1 having a diameter of 80 mm, in accordance with a leading method and a constant load method.

The evaluation of a cleaning property was carried out as follows. The symbol "○" represents a case where no streaks appear on the surface of the photoreceptor due to uncollected toner even when 300K (300,000) paper sheets had been printed (subjected to image formation). The symbol "Δ" represents a case where uncollected toner left streaks partially on the surface of the photoreceptor 1 when 300K paper sheets had been printed. The symbol "X" represents a case where uncollected toner left streaks in a wide range on the surface of the photoreceptor 1 when 1K (1,000) paper sheets had been printed.

The evaluation of charging characteristic was carried out as follows. The symbol "○" represents a case where the electric potential change ΔV of a solid image portion is less than 50 V. The symbol "Δ" represents a case where the electric potential change ΔV of the solid image portion is 50 V or higher but less than 100 V. The symbol "X" represents a case where the electric potential change of a solid image portion is 150 V or higher.

The evaluation of photoreceptor wearing characteristic was carried out as follows. The symbol "○" represents a case where the photoreceptor had an amount of abrasion of 3 μm or less per 100K (100,000) paper sheets and had no damage. The symbol "Δ" represents a case where the photoreceptor had an amount of abrasion of 3 μm to 5 μm per 100K (100,000) paper sheets and had no damage. The symbol "X" represents a case where the photoreceptor had an amount of abrasion of 5 μm or greater per 100K (100,000) and had damage.

The evaluation of printed image quality was carried out as follows. The symbol "○" represents a case where a printed image was good when checked with eyes. The symbol "Δ" represents a case where there occurs a little change in image density in a high-temperature/high-humidity environment and/or a low-temperature/low-humidity environment. The symbol "X" represents a case where a dielectric breakdown, a black spot, an image density change, a fog, and/or an image blurring occur/occurs regardless of environments. The image density change, the fog, and the image blurring are caused due to the destabilization of the charging level of the photoreceptor 1. The dielectric breakdown and the black spot are problems caused due to a charge leak.

The comprehensive evaluation was carried out based on the following scales: ◎=Excellent; ○=Good; Δ=Acceptable (the blade can be practically used without problems); and X=Poor (the blade cannot be practically used).

As described above, a cleaning device of the present technology is a cleaning device provided in an image forming apparatus so as to remove toner from a surface of an image carrier that is driven to rotate, the cleaning device, including: a blade which has an edge portion to be pressed against the surface of the image carrier, so as to remove the toner; and a rotary brush, which is provided in an upstream side of a rotation direction of the image carrier with respect to the blade, and which has bristles whose ends make contact with the surface of the image carrier, so as to supply a lubricant agent to the surface of the image carrier, the blade being made of a blade material having a rebound resilience of 10% to 45%, which is measured by using a JIS K6255 Lupke pendulum type rebound resilience tester, and a Young's modulus of 5 MPa to 11 MPa.

With this, the lubricant agent is supplied to the image carrier by the rotary brush. Therefore, the lubricant agent thus supplied (i) makes it possible to reduce the coefficient of friction between the blade and the image carrier, and (ii) causes the toner to be less adherent to the image carrier. With this, even when small-particle toner with no corner is used, the blade allows a good cleaning property. Furthermore, because the lubricant agent is not contained in a photosensitive layer of the image carrier, the original electrophotographic performance of the image carrier is not degraded.

Moreover, the blade preferably has a rebound resilience of 10% to 45%, more preferably 10% to 40%. Therefore, the abrasion of the image carrier is not accelerated, and the image carrier can be uniformly charged. Even when a contact-charging-type charging device is adopted as the charging device, a charge leak or other problem due to charge concentration does not occur.

That is, the surface of the image carrier becomes uneven because the lubricant agent is supplied to a portion where the bristles of the brush make contact with the surface of the image carrier. For this reason, in cases where a contact-charging-type charging device is combined, a charge leak may be caused. However, the use of the blade having a rebound resilience of 45% or lower allows the lubricant agent to be distributed uniformly on the surface of the image carrier because the edge portion of the blade is appropriately squashed when pressed against the image carrier. When the rebound resilience exceeds 45%, the edge portion is little squashed and it is hard to make the unevenness even. Meanwhile, it is not preferable that the rebound resilience of the blade be lower than 10%. The reason for this is as follows: although the coefficient of friction between the image carrier and the blade is reduced by the lubricant agent, the blade makes contact with the image carrier in a wide range, so that the image carrier is easily worn away. Further, when the rebound resilience is lower than 10%, the resilience of the blade is so low that the blade cannot recover from deformation. This may cause the blade to have a short life span.

Furthermore, the blade preferably has a Young's modulus of 5 MPa to 11 MPa, more preferably 5 MPa to 10 MPa. This allows the blade to be highly elastic and hard. With this, the blade can prevent even small-particle toner with no corner from passing through a space between the image carrier and the blade, and therefore can surely bank up and remove the toner.

That is, as the Young's modulus of the blade becomes higher, the blade banks up the toner better but the abrasion of the image carrier is accelerated. For this reason, a conventional blade has a Young's modulus of 3 MPa to 5 MPa. However, since the rebound resilience of the blade is set to fall within the aforementioned low range, the blade can have a higher Young's modulus than that of the conventional blade. This makes it possible to improve a cleaning property while reducing the abrasion of the photoreceptor 1.

However, when the Young's modulus exceeds 11 MPa, the image carrier is easily worn away. On the other hand, when the Young's modulus is less than 5 MPa, the elastic force becomes so low that the toner easily passes through a space between the image carrier and the blade.

With this, even when small-particle toner with no corner is used, it is possible to (i) improve a cleaning property while allowing a photoreceptor to have a long life span and without degrading the original electrophotographic performance of the photoreceptor and (ii) charge the photoreceptor uniformly.

Therefore, even when the cleaning device of the present technology is provided in a high-speed machine using small-particle toner with no corner, the cleaning device of the present technology (i) improves a cleaning property while allowing a photoreceptor to have a long life span and without degrading the original electrophotographic performance of the photoreceptor and (ii) charges the photoreceptor uniformly.

Further, according to the cleaning device of the present technology, the blade preferably exerts a line pressure of 0.10 N/cm to 0.26 N/cm onto the image carrier, more preferably 0.15 N/cm to 0.20 N/cm. By setting the line pressure to fall within such a range, it is possible to ensure a cleaning property while suppressing the abrasion of the image carrier. When the line pressure is lower than 0.10 N/cm, the lubricant agent may not be applied uniformly. On the other hand, when the line pressure is higher than 0.26 N/cm, the photoreceptor easily worn away and the lubricant agent is not applied to the photoreceptor so as to have an uneven thickness in a circumferential direction of the photoreceptor. By setting the line pressure to be 0.20 N/cm or lower, the abrasion of the photoreceptor can be effectively restrained.

An image forming apparatus of the present technology is an image forming apparatus, including: an image carrier that is driven to rotate; a charging device for charging the image carrier; an exposure device for forming an electrostatic latent image on the image carrier; a developing device for developing, with toner, the electrostatic latent image formed on the image carrier; a transferring device for transferring a developed toner image to a transferring medium; and a cleaning device for removing residual toner from the image carrier, the cleaning device including (i) a blade, which has an edge portion to be pressed against a surface of the image carrier, so as to remove the toner and (ii) a rotary brush, which is provided in an upstream side of a rotation direction of the image carrier with respect to the blade, and which has bristles whose ends make contact with the surface of the image carrier, so as to supply a lubricant agent to the surface of the image carrier, the blade being made of a blade material having a rebound resilience of 10% to 45% and a Young's modulus of 5 MPa to 11 MPa.

It is preferable that the blade make contact with the image carrier at a contact angle of 6° to 25°. When the contact angle is less than 6°, the lubricant agent passes through a space between the image carrier and the blade. This causes application efficiency to be worse. On the other hand, when the contact angle is greater than 25°, an increase in torque on the image carrier, a turnover phenomenon of the blade, or damage of the edge of the blade easily occur under such an environment and/or condition that the friction between the blade and the surface of the image carrier is very high.

Further, in cases where the charging device is a contact-charging-type charging device including a contact charging member for charging the image carrier by making contact with the image carrier, the charging device is easily affected by a cleaning result. Therefore, the arrangement brings about a more remarkable effect.

As described above, even when small-particle toner with no corner is used, a cleaning device of the present technology (i) improves a cleaning property while allowing a photoreceptor to have a long life span and without degrading the original electrophotographic performance of the photoreceptor and (ii) charges the photoreceptor uniformly. Therefore, even when an image forming apparatus including such a cleaning device adopts a contact-charging-type charging device, problems such as a charge leak never occur in the image carrier and it is possible to provide an image with stable quality over a long period of time.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A cleaning device, provided in an image forming apparatus so as to remove toner from a surface of an image carrier that is driven to rotate, the cleaning device, comprising:

a blade comprising an edge portion to be pressed against the surface of the image carrier, so as to remove the toner; and a rotary brush, which is provided in an upstream side of a rotation direction of the image carrier with respect to the blade, the rotary brush comprising bristles whose ends make contact with the surface of the image carrier, so as to supply a lubricant agent to the surface of the image carrier, the blade comprising a blade material having a rebound resilience of 10% to 45% and a Young's modulus of 5 MPa to 11 MPa;

wherein the image forming apparatus is configured to operate at a processing speed of 300 mm/s or faster.

2. The cleaning device as set forth in claim 1, wherein the blade is configured to exert a line pressure of 0.10 N/cm to 0.26 N/cm onto the image carrier.

3. An image forming apparatus, comprising:

an image carrier that is driven to rotate;

a charging device configured to charge the image carrier;

an exposure device configured to form an electrostatic latent image on the image carrier;

a developing device configured to develop, with toner, the electrostatic latent image formed on the image carrier;

a transferring device configured to transfer a developed toner image to a transferring medium; and a cleaning device configured to remove residual toner from the image carrier, the cleaning device, including (i) a blade comprising an edge portion to be pressed against a surface of the image carrier , so as to remove the toner and (ii) a rotary brush, which is provided in an upstream side of a rotation direction of the image carrier with respect to the blade, the rotary brush comprising bristles whose ends make contact with the surface of the image carrier, so as to supply a lubricant agent to the surface of the image carrier, the blade comprising a blade material having a rebound resilience of 10% to 45% and a Young's modulus of 5 MPa to 11 MPa;

wherein the image forming apparatus is configured to operate at a processing speed of 300 mm/s or faster.

4. The image forming apparatus as set forth in claim 3, wherein the blade is configured to exert a line pressure of 0.10 N/cm to 0.26 N/cm onto the image carrier.

5. An image forming apparatus, comprising:

an image carrier configured to be driven to rotate;

a charging device configured to charge the image carrier;

an exposure device configured to form an electrostatic latent image on the image carrier;

a developing device configured to develop, with toner, the electrostatic latent image formed on the image carrier;

a transferring device configured to transfer a developed toner image to a transferring medium; and a cleaning device configured to remove residual toner from the image carrier, the charging device being a contact-charging-type charging device including a contact charging member for charging the image carrier by making contact with the image carrier, the cleaning device, including (i) a blade comprising an edge portion to be pressed against a surface of the image carrier , so as to remove the toner and (ii) a rotary brush, which is in an upstream side of a rotation direction of the image carrier with respect to the blade, the rotary brush comprising bristles whose ends make contact with the surface of the image carrier, so as to supply a lubricant agent to the surface of the image carrier, the blade comprising a blade material having a rebound resilience of 10% to 45% and a Young's modulus of 5 MPa to 11 MPa;

wherein the image forming apparatus is configured to operate at a processing speed of 300 mm/s or faster.

6. The image forming apparatus as set forth in claim 5, wherein the blade is configured to exert a line pressure of 0.10 N/cm to 0.26 N/cm onto the image carrier.

* * * * *